US005282347A

United States Patent [19]

Cleine et al.

[11] Patent Number: 5,282,347

[45] Date of Patent: Feb. 1, 1994

[54] WRAPPING APPARATUS

[75] Inventors: Kenneth D. Cleine, Dromana; John G. Venturin, both of McCrae, Australia

[73] Assignees: John Lysaght (Australia) Limited, Sydney; K.C. Metal Products Proprietary Limited, Victoria, both of Australia

[21] Appl. No.: 942,067

[22] Filed: Sep. 9, 1992

[30] Foreign Application Priority Data

Nov. 12, 1991 [AU] Australia ..... PK9726
Apr. 13, 1992 [AU] Australia ..... PL1886

[51] Int. Cl.[5] ..... B65B 11/30; B65B 11/40; B65B 11/28

[52] U.S. Cl. ..... 53/204; 53/588

[58] Field of Search ..... 53/204, 409, 399, 588, 53/587, 589

[56] References Cited

U.S. PATENT DOCUMENTS

| | | | |
|---|---|---|---|
| 3,116,032 | 12/1963 | Roberts . | |
| 3,348,787 | 10/1967 | Giles | 242/75.5 |
| 3,486,293 | 12/1969 | van de Bilt | 53/66 |
| 4,761,934 | 8/1988 | Lancaster | 53/399 |
| 4,829,753 | 5/1989 | Bricmont | 53/204 X |

FOREIGN PATENT DOCUMENTS

| | | | |
|---|---|---|---|
| 70436/81 | 11/1981 | Australia . | |
| 74969/81 | 3/1982 | Australia . | |
| 0044627 | 1/1982 | European Pat. Off. . | |
| 0371892A1 | 6/1990 | European Pat. Off. . | |
| 1244045 | 4/1964 | Fed. Rep. of Germany . | |
| 2256708 | 5/1974 | Fed. Rep. of Germany . | |
| 2057524 | 5/1971 | France . | |
| 761374 | 9/1980 | U.S.S.R. | 53/204 |
| 982977 | 12/1982 | U.S.S.R. | 53/204 |
| 1465347 | 3/1989 | U.S.S.R. | 53/204 |
| 2079730A | 1/1982 | United Kingdom . | |

OTHER PUBLICATIONS

Derwent Abstract Accession No. 91-049006/07, class Q31, SU, A, 1570944 (Kaun Poly) Jun. 15, 1990.

Derwent Abstract Accession No. J4161Y/41, class Q31, SU, A, 545524 (Tbilisi Prodmash) Apr. 6, 1977.

*Primary Examiner*—James F. Coan

*Attorney, Agent, or Firm*—Nikaido, Marmelstein, Murray & Oram

[57] ABSTRACT

A wrapping apparatus applies a wrapping medium to an annular article such as a coil of a metal strip, to cover the inner surface as well as the outer surfaces thereof. The apparatus includes a rigid loop structure defining an endless T-sectioned track, and extends as a cantilever extending from a free standing columnar support. The support includes an elevator device for raising and lowering the loop structure. The loop structure includes a hinged gate portion that may be moved to an open position to enable the track to be linked with the annular article, and then reclosed. A self-propelled shuttle moves around the track and carries a dispensing device and a prestretching device that hold wrapping medium and enable the medium to be removed from the coil. A trolley with two power driven rollers continuously reorients the article as wrapping proceeds. A take-up accumulator device is disposed on the shuttle, and includes a plurality of fixedly positioned training rollers, a plurality of yieldably positioned training rollers, and a pneumatic loading device which resiliently loads the yieldably positioned rollers away from the fixedly positioned rollers, so as to maintain tension in the wrapping media.

19 Claims, 4 Drawing Sheets

5
6
7
8
9
10
11
12
13
14
15
16
17
18
44
45
46
47

WRAPPING APPARATUS

TECHNICAL FIELD

This invention relates to the packaging of goods, being an article or a bundle of articles, for their protection against corrosion or soiling by liquid or particulate contaminants during handling, transporting and storage operations.

The invention was developed for the protective packaging of coils of steel strip and is described primarily with regard to that application hereinafter. It will be appreciated however that it is generally applicable to wrapping other goods in the nature of relatively large solid items.

BACKGROUND ART

Such packaging is discarded when the goods are put to use, and so it is desirable not only for the package itself to be inexpensive in so far as its materials and construction are concerned, but also for it to be applicable to and removable from the goods expeditiously and with a minimum of labour. Those desiderata are to some extent incompatible with the imperative that the package reliably exclude contaminants for what may be a lengthy period.

One widely adopted proposal to resolve that incompatibility has been to wrap or swathe the article or bundle in substantially impervious, pliable sheet or strip wrapping medium. An excellent wrapping medium for the purpose is so-called stretch wrap plastics film, which is chemically inert, proof to most liquids including water, and tends to cling to anything it contacts including itself. That film is stretched prior to or during its application to the article or bundle. It has the property known as "memory" which means it seeks to return to the unstretched state. As a result it tends to mould itself to the article and form a tight wrapping thereon.

One class of known apparatus for applying a pliable wrapping medium has comprised a turntable or the like on which the article is placed and a draw-off spool holder rotatably supporting a spool of the wrapping medium. In use, an end of the wrapping medium is taped or otherwise secured to the article and the article is rotated to draw wrapping medium from the spool holder and wrap itself therein. The spool holder includes tension regulating devices to maintain a suitable tension in the drawn-off medium and, in the case of stretch wrap film, to stretch it as it leaves the spool. The spool-holder (or the turntable) may be moved in the axial direction of the spool to cause successive turns of the wrapping medium applied to the article to overlap and so provide an uninterrupted coverage. As a general rule the article has to be reoriented on the turntable at least once during the wrapping to obtain full coverage. Alternatively, if the shape of the article permits, it may be continuously reoriented on the turntable as wrapping proceeds.

Disadvantages of this class of known wrapping apparatus are the limitations on the shapes of the articles that may be wrapped and the limitation on the mass of the article if the expense of providing a heavy duty turntable with high power drive and braking systems is to be avoided.

Another class of known apparatus which alleviates the last mentioned disadvantage provides a rotatable frame which supports the spool holder so that it may orbit about the article being wrapped. In this instance the article may be stationary except for such intermittent or continuous reorientation as may be needed for full coverage. For example, a cylindrical article may be supported on two spaced apart parallel rollers with their axes horizontal. At least one of those support rollers may be driven to cause the article to turn slowly about its own, also horizontal, axis. The spool holder may be set to orbit the article in a generally horizontal plane, but which may be raised or lowered, with the spool axis vertical. Depending on the altitude of the spool relative to the axis of the article, the drawn-off medium will cover the whole of the article or will leave uncovered a central circular area of greater or lesser diameter of each end face of the article. In the event that the cylindrical article is also annular, for example a coil of metal strip, those uncovered areas may be adjusted to substantially coincide with the ends of the bore of the coil.

The main disability of this last mentioned class of known apparatus is once again the limitation on the shape of the articles that may be conveniently wholly wrapped.

Another class of known wrapping apparatus particularly suited to wrapping elongate articles comprises a circular structure which carries a spool holder. That structure is caused to rotate about its own axis, which is horizontal, to produce orbital movement of the spool holder about that axis. The article to be wrapped is passed by appropriate conveyors through the structure along that axis.

DISCLOSURE OF INVENTION

Therefore, the known art is quite well adapted for the external wrapping of reasonably compact or elongated articles, but is less well able to wrap oddly shaped articles. In particular it does not permit the wrapping of large annular cylindrical articles, such as coils of metal strip, in a manner which covers not only the external surfaces but also the internal or bore surface, and an object of the present invention is to provide apparatus which may do that if desired.

The invention achieves that object by providing a wrapping apparatus wherein the spool holder is mounted on a shuttle able to ride around an endless, stationary track on a loop structure having a gate portion which may be opened, that is to say temporarily swung aside or detached from the remainder of the loop structure, to permit an annular article to be linked with the track.

Therefore, the invention consists in a wrapping apparatus comprising a loop structure defining an endless track, a shuttle able to ride around said track, dispensing means on said shuttle able to hold a coil of a pliable wrapping medium and enabling medium to be drawn from the coil, and work piece support means able to support an article to be wrapped with at least a part of the article surrounded by said track; said loop structure including a gate portion that may be opened to produce a gap in said track and then closed, whereby an annular article may be linked with said track.

In use, a coil of wrapping medium is loaded into the dispensing means. An article is positioned on the support means so that it, or at least that part of it that is to be wrapped, as the case may be, is within the ambit of the track. If need be the gate portion is opened to allow the article to be put in place, and then reclosed. An end of the wrapping medium may then be secured to the article and the shuttle set in motion so that it orbits the article or the relevant part thereof. In this way the wrapping medium is drawn from the shuttle and applied to the article. In the case of an annular article when it is desired to cover the internal surface, the article is positioned so that the path of the dispensing means extends through the opening in the article.

A problem inherent in apparatus according to the invention, which is not usually present in prior known apparatus wherein relative rotation between the article and the roll about a fixed axis is relied upon to draw wrapping medium from the roll, is the difficulty of maintaining a tight wrap if there is a "mismatch" between the shape of the article being wrapped and the path of the shuttle. Such a mismatch occurs if more wrapping medium is drawn from the shuttle during a part of its travel than is taken up by the article during an immediately following part of its travel. This problem may be met or alleviated by appropriate shaping of the shuttle path if the article to be wrapped does not change, but is likely to arise during the operation of general purpose apparatus intended to be used for wrapping a variety of articles.

Thus preferred embodiments of the invention further comprise take-up accumulator means on the shuttle, which means are able to accommodate, and maintain tension in, a variable quantity of drawn off medium prior to its application to the article.

For preference the take-up accumulator means comprise a plurality of fixedly positioned training rollers, a plurality of yieldably positioned training rollers and loading means resiliently loading the yieldably positioned rollers away from the fixedly positioned rollers, so as to maintain tension in a variable length of wrapping media extending in a tortuous path about the respective rollers.

BRIEF DESCRIPTION OF THE DRAWINGS

By way of example, an embodiment of the above described invention is described in more detail hereinafter with reference to the accompanying drawings.

BEST MODE OF CARRYING OUT THE INVENTION

Figure 1:
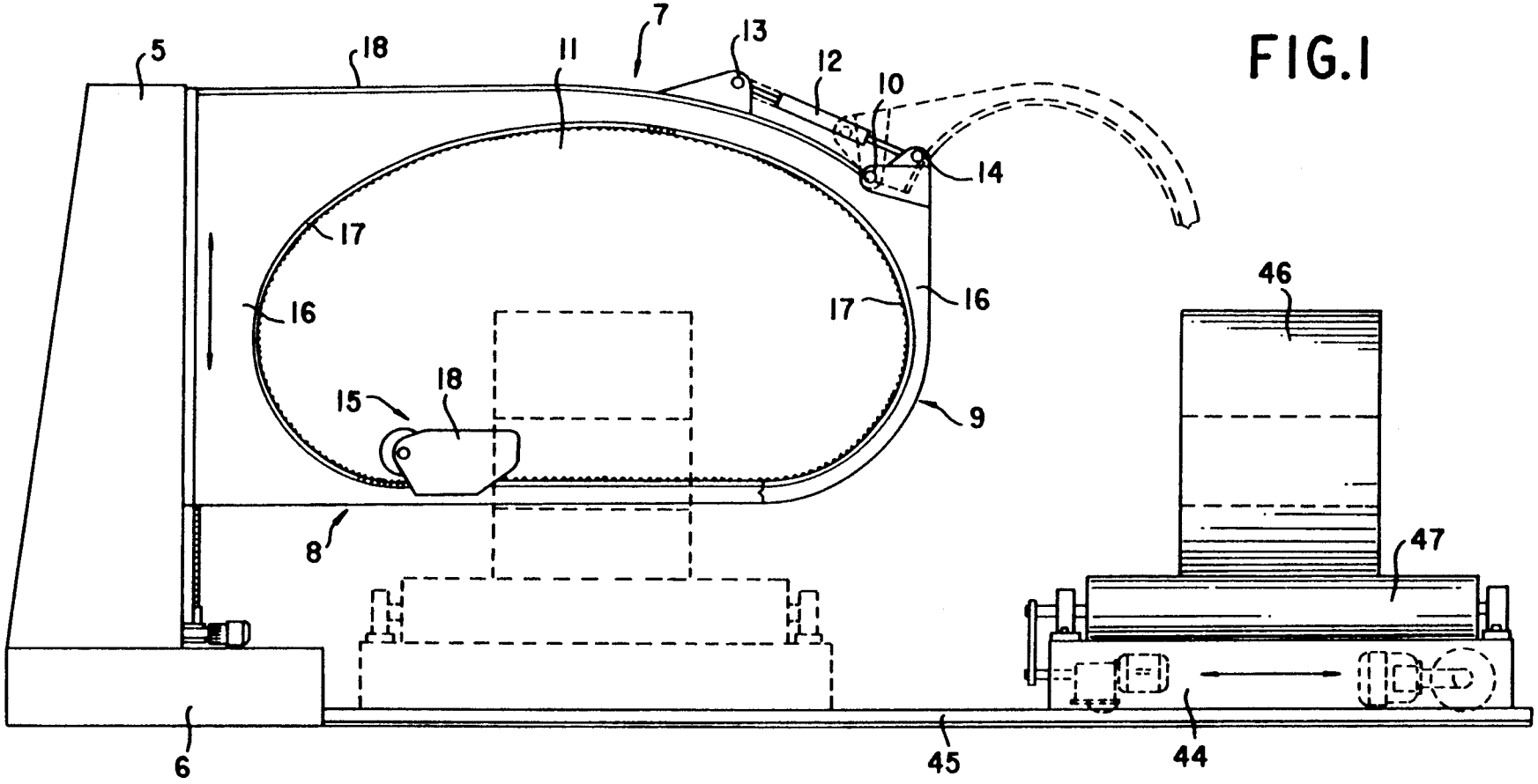
FIG. 1 is a side elevation of a wrapping apparatus according to the invention.
Figure 2:
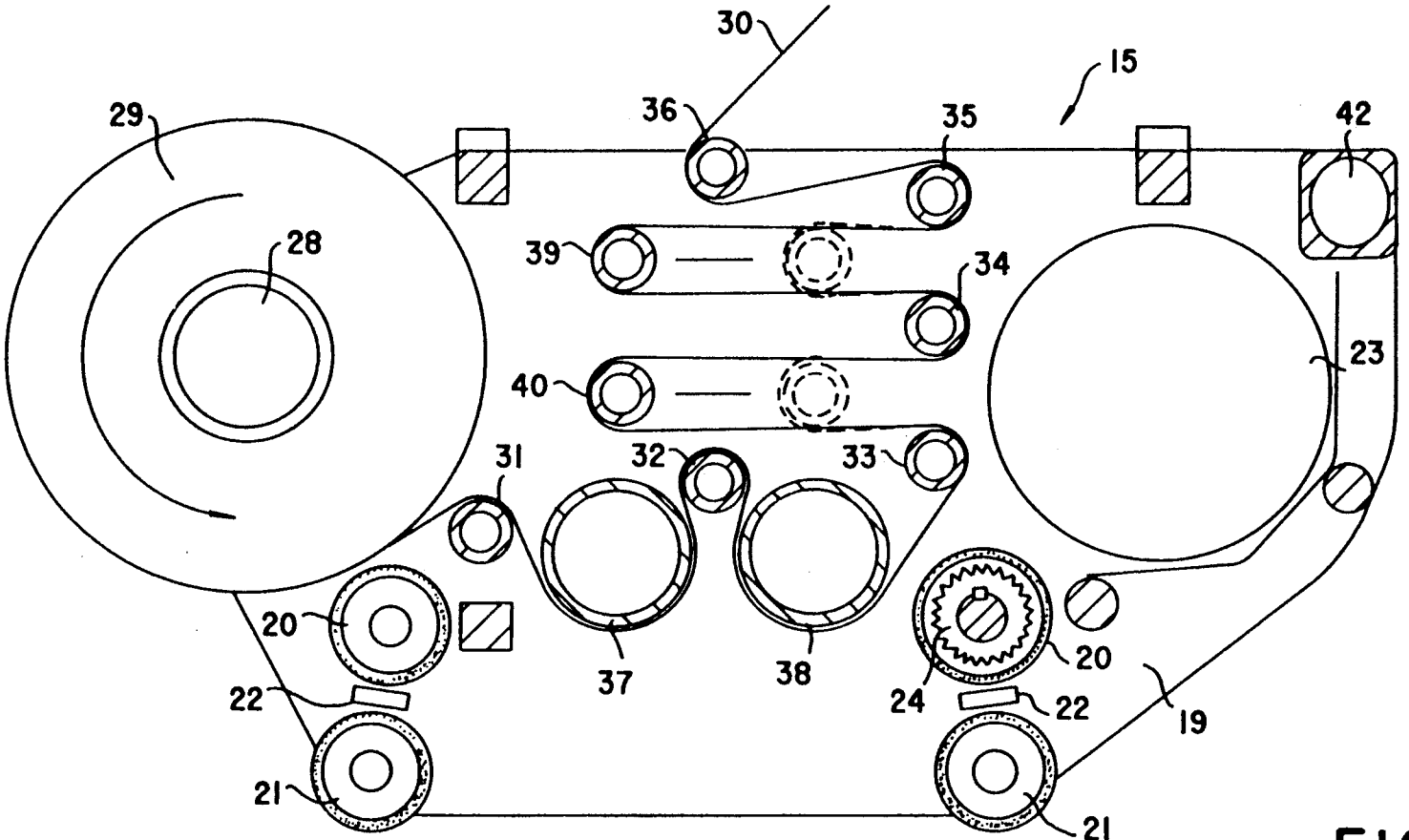
FIG. 2 is a diagrammatic longitudinal section through a shuttle, being a component of the apparatus of FIG. 1.

The illustrated embodiment of the invention comprises a free standing support structure comprising a fabricated or cast metal column 5 extending rigidly upwardly from a floor mounting base 6. It supports a rigid loop structure comprising two spaced apart, co-directed cantilever beams 7 and 8 projecting from the column 5 and positioned one above the other in a common vertical plane and a gate portion 9 hinged at 10 one end to the free end of the upper beam 7 and extending, in its closed position, to the free end of the lower beam 8. The beams 7 and 8 and the gate portion 9 are preferably fabricated from steel plate and may comprise webs 16, inner edge flanges 17 and, in the case of beam 7, an outer edge flange 18.

For preference the loop structure as a whole may be raised or lowered as needed, by any conventional elevating mechanism associated with the column 5. For example, it may be slideably mounted on the column and engaged by motor driven nuts threaded upon a screwed post within the column. Alternatively the nuts may be fixed and the post rotatable, or an hydraulic or other thrustor may act directly on the loop structure.

As may be seen in FIG. 1 the gate portion 9 is a smoothly curved C shaped body and the junction between the bottom surface of the upper beam 7 and the upper surface of the lower beam 8 adjacent the column 5 is similarly smoothly curved.

Thus the beams 7 and 8 and the gate portion 9, when in the closed position, constitute an elongated rigid loop structure projecting from the column. That loop structure lies in a vertical plane with its long dimension substantially horizontal, it is spaced above the floor, preferably to an adjustable extent, and the opening 11 defined by it has a straight lower side and smoothly curved upper side and ends.

The axis of the gate portion hinge 10 extends transversely of the loop structure so that the gate portion 9 may be swung upwardly from a closed position (shown in full line in FIG. 1), wherein its two ends respectively register with the free ends of the beams 7 and 8, to an open position (shown in broken line), wherein it is substantially clear of the beams. The ends of the gate portion 9 and the free ends of the beam 7 and 8 may be furnished with tapered inter-engaging formations or the like to ensure an accurate register therebetween.

The gate portion 9 may be swung as aforesaid by means of a hydraulic or pneumatic cylinder 12 extending from a pivot connection 13 on the upper beam across the hinge axis to a pivot connection 14 on the gate portion 9. Those pivot connections are on pedestals so that the line of action of the cylinder 12 is spaced above the hinge axis 10.

A shuttle 15 is provided which may ride around the inner periphery of the loop structure on a guide track formed, in this instance the guide track may be seen as a T-sectioned rail formed by the inner flanges 17 and the adjacent margin of the webs 16 of the beams 7 and 8 and the gate portion 9.

The shuttle 15 comprises two rigidly spaced apart side plates 19 on and between which are rotatably mounted two pairs of inner track wheels 20, two pairs of outer track wheels 21 and two pairs of side track wheels 22. Those wheels may be moulded plastics wheels mounted for free rolling, in the case of the inner and outer wheels, on axles extending from one side plate 19 to the other and, in the case of the side track wheels, on brackets attached to the respective side plates. It will be clear to the skilled reader that the track wheels as a whole retain the shuttle to the head flange of the T-sectioned guide track while permitting it to ride therealong.

The shuttle 15 is self-propelled by an electric motor 23 mounted on one side plate 19 and drive connected by conventional means (not shown) to a pinion 24 fixed to a rotatable one of the inner track wheel axles and engaged with a rack 48 on, and extending for the full lengths of, the flanges 17.

The motor 23 may be energised by way of wiper contacts on the shuttle contacting rigid electric supply conductors mounted on, and extending for the full lengths of, the inner margins of the webs 16. In the illustrated embodiment those wiper contacts and conductors are conventional items that are commercially available. They comprise conductor rails housed deep within insulating channels 25 and coacting sets of shoes 26 adapted to enter the mouths of the channels to make sliding contact with the rails. The shoes 26 are resiliently mounted on insulated conducting arms 27 rigidly mounted on a shuttle side plate 19. Two sets of shoes 26 are provided in respect of each rail to maintain continuity of supply as the shuttle travels across the junctions between the gate portion 9 and the beams 7 and 8.

The supply to the conductor rails on the gate portion 9 may be maintained by contact at the beam ends when the gate portion is in the closed position, but for preference the supply is maintained by flexible conductors spanning the hinge.

The shuttle 15 further comprises a mandrel or other spool holder 28 for a roll 29 of pliable wrapping medium, for example stretch plastic wrapping film, from which film 30 may be drawn, six fixedly positioned training rollers 31 to 36 respectively, two pre-stretch rollers 37 and 38 respectively, and two yieldably positioned training rollers 39 and 40 respectively.

The pre-stretch rollers 37 and 38 cooperate with the training rolls 31, 32 and 33 to effect initial stretching of the film 5 as it leaves the roll 29. Their curved surfaces are conditioned in known manner to provide a considerable degree of friction between those surfaces and the film 30. Furthermore prestretch roller 38 runs at a higher speed than roller 37 so that the film 30 is necessarily stretched as it passes around the rollers. They also provide a brake on the film enabling it to be kept in tension by the article being wrapped.

Figure 3:
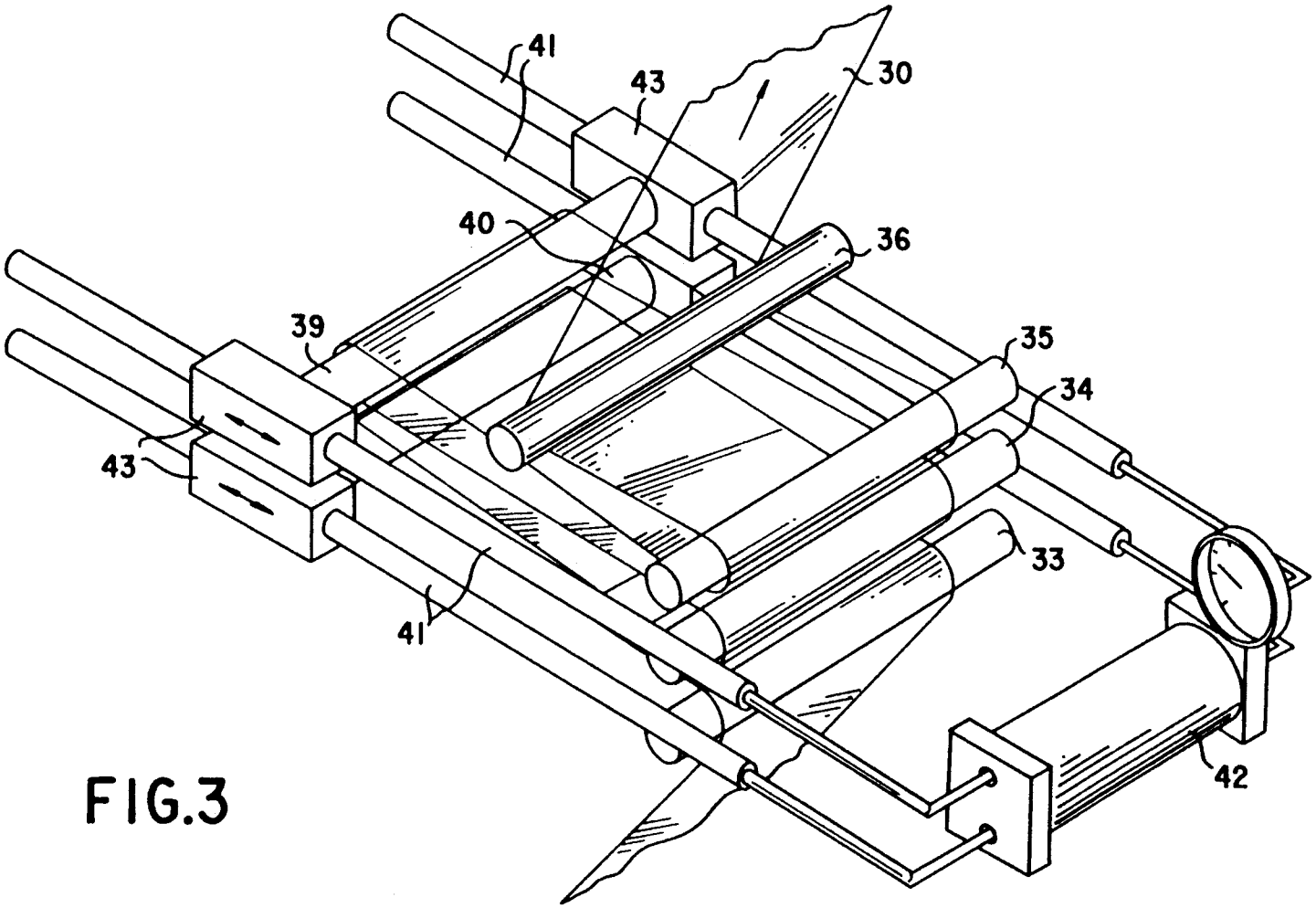
FIG. 3 is a diagrammatic perspective view of take-up accumulator means, being components of the shuttle of FIG. 2.
Figure 4:
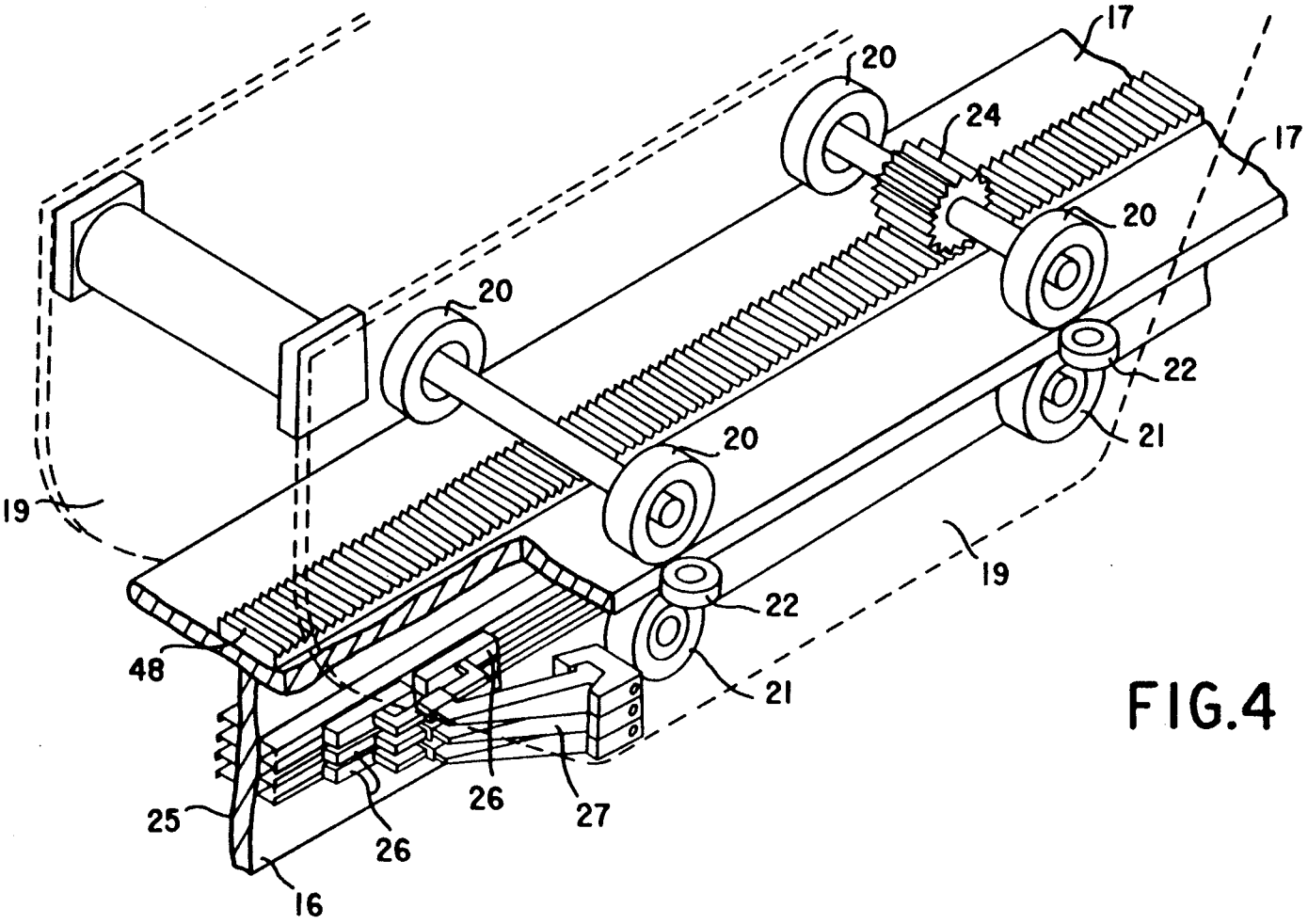
FIG. 4 is a diagrammatic perspective view of some internal parts of the shuttle of FIG. 2, showing more particularly its track wheels and electrical pick-up arrangements.

The rollers 39 and 40 are resiliently loaded away from the rollers 33, 34 and 35 by loading means comprising, in this instance, so called rodless pneumatic cylinders 41 that are each vented at one end and connected at its other end to a pressurised air reservoir 42. The cylinders 41 are also conventional proprietary items. Essentially each comprises an elongate cylinder with an internal piston and an external saddle 43, both of which are slidable longitudinally of the cylinder. The piston and saddle are kept in register by strong interacting permanent magnets respectively fixedly associated with them. This enables the rollers 39 and 40 to move to and for with the saddles 43, as indicated by the arrows in FIG. 3, while maintaining a substantially constant tension in the variable quantity of the film 30 trained around them and the rollers 33, 34 and 35. The volume of the reservoir 42 is sufficient to ensure that the air pressure within the cylinders 41 does not vary greatly as the pistons therein move to and fro.

It will be appreciated that in other embodiments the numbers and spacing of the rollers of the accumulator means may be different from that illustrated and the loading means may take other convenient form, for example springs or a capstan drum driven through a constant torque, slipping clutch.

A work piece support means is provided at a lower level than the loop structure. That support means may be fixed in position but preferably it is in the nature of a trolley 44 able to run on floor rails 45 to enable it to be loaded with the work piece, for example a coil 46 of steel strip elsewhere, and then brought into position below the loop structure (as indicated in broken line in FIG. 1). If the support means are fixed in position, it is desirable for the loop structure to be movable horizontally. Thus, in the instance of apparatus along the lines of that illustrated, the column base 6 would be designed to run on rails corresponding to the rails 45.

In either event the work piece support means preferably have two power driven, spaced apart, horizontal rollers 47 for the support of the work piece 46.

In use, the gate portion 9 is moved to the open position, the coil 46 of metal strip or other annular article to be wrapped is then positioned on the work piece support rollers 47, and those means moved along the rails 45 so that the lower beam 8 extends through the bore of the coil 46, the gate portion 9 is then closed so that the shuttle track is linked with the work piece 46, that is to say a part of the endless track extends through the bore of the work piece 46. An end of film 30 may then be drawn from the shuttle 15 and taped or otherwise fixed to the work piece 46. The shuttle 15 is then set in motion to wrap a turn of film around the upper part of the work piece and the work piece support means rollers 47 are set going until successive overlapping turns of film cover the entire surface of the coil 46, including its inner bore surface.

Whereas the invention may wrap annular articles as described above it is not limited to such use. The provision of a carriage mounted spool holder travelling around an endless, gated track permits the ready positioning of many articles so that they are surrounded by the carriage path and therefore able to be wrapped by the carriage following that path. In such other instances the work piece support means may be adapted for the support of non-annular work pieces. For example elongated articles may be passed continuously through the track loop by appropriate conveyors of known kind.

Furthermore, the gate portion is not necessarily hingedly moved or swung between its open and closed position. It may be moved translationally or bodily from one position to the other. Such translational movement may be in the plane of the remainder of the loop structure or transversely thereof. In one preferred alternative arrangement, the gate portion is effectively the top part of a more upright loop structure than that illustrated. It is opened by being lifted from the lower part of the structure and closed by being lowered onto the lower part. In one such instance, a loop structure similar to that illustrated is provided, except that only the top part of the structure is raised and lowered by elevator means associated with a column corresponding to column 5. Also in this instance the work piece support means may comprise a circular array of axially radiating conical rollers for the support of a work piece such as coil 46 lying on one end and its rotation about its then vertical axis.

We claim:

1. Wrapping apparatus comprising a loop structure defining an endless track, a shuttle able to ride around said track, dispensing means on said shuttle able to hold a coil of a pliable wrapping medium and enabling medium to be drawn from the coil, and workpiece support means able to support and reorient an article to be wrapped with at least a part of the article surrounded by said track; said loop structure includes a gate portion that may be moved to an open position to create a gap in said track and then returned to a closed position to eliminate said gap, wherein an annular article may be linked with said track; said shuttle carries take-up accumulator means comprising a plurality of fixedly positioned training rollers, a plurality of yieldably positioned training rollers and loading means resiliently loading the yieldably positioned rollers away from the fixedly positioned rollers, so as to accommodate, and maintain tension in, a variable length of said wrapping medium when extending in a tortuous path about the respective training rollers.

2. Wrapping apparatus according to claim 1, further comprising a free standing support structure from which said loop structure projects so as to be spaced above a floor on which said free standing support structure stands.

3. Wrapping apparatus according to claim 1, further comprising a free standing support structure for said loop structure comprising elevator means whereby said loop structure may be raised and lowered.

4. Wrapping apparatus according to claim 1, wherein at least one of said loop structure and said workpiece support means is moveable horizontally with respect to the other.

5. Wrapping apparatus according to claim 1, wherein said workpiece support means comprise a pair of spaced apart, axially parallel, cylindrical rollers of which at least one is power driven.

6. Wrapping apparatus according to claim 1, wherein said loading means comprise a pressurable gas reservoir and, in respect of each of said yieldably positioned training rollers, at least two rodless pneumatic cylinders comprising external saddles that remain in register with a piston within the cylinder and to which said each yieldably positioned training roller is mounted; one end of each cylinder being vented and the other end being pipe connected to said reservoir.

7. Wrapping apparatus according to claim 1, wherein the track comprises a T-sectioned rail comprising a head flange and said shuttle comprises two rigidly spaced apart side plates on and between which are rotatably mounted two pairs of inner track wheels, two pairs of outer track wheels and two pairs of side track wheels adapted to retain the shuttle to the head flange of said rail while permitting it to ride therealong.

8. Wrapping apparatus according to claim 1, wherein said shuttle is self-propelled by an electric motor drive connected to a pinion and engaged with a rack on, and extending for the full length of, said track.

9. Wrapping apparatus comprising a loop structure defining an endless track, a shuttle able to ride around said track, dispensing means on said shuttle able to hold a coil of a pliable wrapping medium and enabling medium to be drawn from the coil, and workpiece support means able to support and reorient an article to be wrapped with at least a part of the article surrounded by said track; said loop structure includes a gate portion that may be moved to an open position to create a gap in said track and then returned to a closed position to eliminate said gap, wherein an annular article may be linked with said track; said shuttle comprises prestretch means to stretch medium drawn from said coil of medium before it departs from the shuttle.

10. Wrapping apparatus according to claim 9, further comprising a free standing support structure from which said loop structure projects so as to be spaced above a floor on which said free standing support structure stands.

11. Wrapping apparatus according to claim 9, further comprising a free standing support structure for said loop structure comprising elevator means whereby said loop structure may be raised and lowered.

12. Wrapping apparatus according to claim 9, wherein at least one of said loop structure and said workpiece support means is moveable horizontally with respect to the other.

13. Wrapping apparatus according to claim 9, wherein said workpiece support means comprise a pair of spaced apart, axially parallel, cylindrical rollers of which at least one is power driven.

14. Wrapping apparatus according to claim 9, wherein said shuttle carries take-up accumulator means able to accommodate, and maintain tension in, a variable quantity of drawn off medium prior to its application to the article to be wrapped.

15. Wrapping apparatus according to claim 9, wherein said shuttle carries take-up accumulator means comprising a plurality of fixedly positioned training rollers, a plurality of yieldably positioned training rollers and loading means resiliently loading the yieldably positioned rollers away from the fixedly positioned rollers, so as to maintain tension in a variable length of wrapping media extending in a tortuous path about the respective training rollers prior to its application to the article to be wrapped.

16. Wrapping apparatus according to claim 9, wherein said shuttle carries take-up accumulator means comprising a plurality of fixedly positioned training rollers, a plurality of yieldably positioned training rollers and loading means resiliently loading the yieldably positioned rollers away from the fixedly positioned rollers, so as to maintain tension in a variable length of wrapping media extending in a tortuous path about the respective training rollers prior to its application to the article to be wrapped, and wherein said loading means comprise a pressurable gas reservoir and, in respect of each of said yieldably positioned training rollers, at least two rodless pneumatic cylinders comprising external saddles that remain in register with a piston within the cylinder and to which said each yieldably positioned training roller is mounted; one end of each cylinder being vented and the other end being pipe connected to said reservoir.

17. Wrapping apparatus according to claim 9, wherein said track comprises a T-sectioned rail comprising a head flange and said shuttle comprises two rigidly spaced apart side plates on and between which are rotatably mounted two pairs of inner track wheels, two pairs of outer track wheels and two pairs of side track wheels adapted to retain the shuttle to the head flange of said rail while permitting it to ride therealong.

18. Wrapping apparatus according to claim 9, wherein said shuttle is self-propelled by an electric motor drive connected to a pinion and engaged with a rack on, and extending for the full length of, said track.

19. Wrapping apparatus according to claim 9, wherein said gate portion is hinged to the loop structure.

* * * * *